US005207164A

United States Patent [19]

Breen et al.

[11] Patent Number: 5,207,164

[45] Date of Patent: May 4, 1993

[54] PROCESS TO LIMIT THE PRODUCTION OF FLYASH BY DRY BOTTOM BOILERS

[75] Inventors: Bernard P. Breen, Pittsburgh, Pa.; James E. Gabrielson, Plymouth, Minn.; Robert A. Schrecengost, Brooklyn, N.Y.

[73] Assignee: Consolidated Natural Gas Service Company, Inc., Pittsburgh, Pa.

[21] Appl. No.: 868,702

[22] Filed: Apr. 15, 1992

[51] Int. Cl.[5] ..... F23J 15/00

[52] U.S. Cl. ..... 110/345; 110/165 A; 110/216

[58] Field of Search ..... 110/165 R, 165 A, 345, 110/216, 212, 344

[56] References Cited

U.S. PATENT DOCUMENTS

| | | | |
|---|---|---|---|
| 2,024,197 | 12/1935 | Bailey et al. . | |
| 2,263,433 | 11/1941 | Allen . | |
| 2,917,011 | 12/1952 | Korner . | |
| 4,671,192 | 6/1987 | Hoffert et al. . | |
| 4,796,545 | 1/1989 | Hashizaki et al. . | |
| 4,800,825 | 1/1989 | Kuenzly . | |
| 5,044,286 | 9/1991 | Breen et al. | 110/165 A |
| 5,078,065 | 1/1992 | Tsunemi et al. | 110/165 A X |

*Primary Examiner*—Edward G. Favors

*Attorney, Agent, or Firm*—Buchanan Ingersoll

[57] ABSTRACT

In a process to limit the production of flyash by dry bottom boilers, flyash is collected from flue gas using a collector such as an electrostatic precipitator. The collected flyash is carried in a carrier gas stream to which a fuel is added. The stream is introduced into the boiler in a manner to cause the flyash to soften, agglomerate and fall into the bottom ash pit.

26 Claims, 3 Drawing Sheets

PROCESS TO LIMIT THE PRODUCTION OF FLYASH BY DRY BOTTOM BOILERS

BACKGROUND OF THE INVENTION

1. Field of the Invention

The present invention relates to a process for reducing the production of flyash in a dry bottom boiler. More specifically, the process relates to fusing or combining together many small particles by heating them sufficiently to soften or melt their surfaces and impinging them on each other, or even to melting the small particles together and having the resulting larger agglomerates fall out the bottom of the boiler.

2. Description or the Prior Art

In dry bottom furnaces there has been limited effort to increase the amount of ash being discharged as bottom ash. Neither the flyash nor the bottom ash have commercial uses nearly as large as the supply. The flyash finds some use as pozzolanic material in cement or concrete. Various uses have been found for the bottom ash but they are limited and not as well established as the aggregate or blast cleaning markets of the bottom ash from wet bottom boilers. Usually both the flyash and the bottom ash from a dry bottom boiler must be disposed of in ponds or landfills. Even though the flyash can easily be blown about and causes fugitive emissions at every step of the disposal, few efforts have been made to increase the proportion of the ash which is disposed of as bottom ash from dry bottom boilers.

In dry bottom boilers, the flyash which does not impinge on and stick to water walls, steam tubes or other parts of the boiler and then subsequently fall into hoppers, either passively or as a result of some action of the operator, exits the boiler as flyash. In dry bottom boilers about 80% of the ash is usually thought to leave the boiler as flyash and only 20% as bottom ash. This contrasts to wet bottom boilers, where 80% of the ash is usually thought to exit the boiler as bottom ash and only 20% as flyash, and the bottom ash is expected to flow from the boiler as a liquid. The bottom ash is usually agglomerates of ultimate ash particles which are loosely fused together, but part of the agglomeration may be completely melted together. So complete melting techniques such as described in our U.S. Pat. No. 5,044,286 which are useful in wet bottom boilers would not work in dry bottom boilers. Part of the bottom ash, or slag as the worst of the accumulations are called before they reach the bottom hopper, may be molten and may run or drip, but the normal and desired behavior of wall ash in dry bottom boilers is as solid material. As a solid material, the ash may fall of its own weight or by being blown with strong blasts of air or steam flowing from soot blowers. When the boiler load is reduced in response to low demand at some part of the day or week, or in response to ash accumulations, the ash may fall off because it cools and fractures or the tubes contract and the ash is shed by the differential expansion or contraction. For easy removal from boiler surfaces, it can be seen that solid ash is preferred.

The flyash which exits the boiler in the flue gas stream is usually very small particles. The mass mean average diameter is below 50 micrometers and often below 20 micrometers. The particles are the ultimate ash particles. In order to reduce air pollution by these particles, they are collected in various air cleaning devices such as electrostatic precipitators and baghouses. When the particles are collected in the devices they are often agglomerated, but the agglomerates are neither as big nor as strong as the agglomerates which make up the bottom ash from dry bottom boilers. The bottom ash particles or agglomerates are typically from 100 micrometers to several centimeters in diameter. While the bottom ash is less difficult to handle, there has been little effort to increase the fraction of the bottom ash from dry bottom boilers.

The bottom ash is more desirable from a handling, storage, transportation, and disposal viewpoint since it is not so easily blown about by the wind. Some of it can be used as aggregate material. Most importantly, due to its larger size it will be less of a leaching hazard. The United States Environmental Protection Agency has established extraction tests to determine if coal ash is hazardous. The present procedures are set forth in 40 CFR 260.20 and 260.21. It is emphasized that the test of ash for being hazardous is based on how much of a given element is extractable from a sample, not on how much is in a sample. The sample is crushed to pass a ⅜-inch (9.5 mm) sieve and extracted with water to which acetic acid is added to keep the pH at 5.0. The sample is contacted with the weak acid for 24 hours, after which time the liquid is tested for metals. The extract is tested for arsenic, barium, cadmium, chromium, lead, mercury, selenium, and silver. A concentration limit is specified for each metal and if one exceeds the specified limit, the ash is considered as having EP Toxicity and considered a hazardous waste. It is well known that disposal of hazardous waste is very expensive and should be avoided if possible.

It is true and recognized by people familiar with the arts of extraction and lixiviation that soluble materials are much more readily extracted from small particles than from large particles. Because small particles have higher surface area/volume ratios than large particles, a higher proportion of the soluble materials are at the surface of the particle and come into contact with the extraction liquid. Therefore, that ash with large particles will often be judged non-toxic while the same ash having small particle sizes would be found to be toxic. Because of their small size the sample crushing procedure specified in the test is not relevant to flyash particles. It would take over 100 million spheres of flyash, which on average is 20 micrometers in diameter, to make one 9.5 millimeter diameter sphere. By increasing the size of ash particles they are made more safe for disposal.

There are four benefits to converting part of the flyash into the larger size bottom ash. They are 1) the bottom ash is not so dusty and does not blow around so much, reducing fugitive emissions and making it easier to handle and dispose of; 2) not having toxic flyash blowing about so much will make working conditions safer; 3) some of the bottom ash may be sold for aggregate or for other uses; 4) the ash will be much less likely to be a hazardous waste, reducing disposal costs.

Procedures have been developed to recycle flyash to boilers in order to burn out the carbon in the flyash and increase the efficiency of the boilers. However, this technique frequently results in the flyash being recirculated a great number of times without any significant increase in the fraction of the incoming ash ultimately leaving the boiler as bottom ash. The ash is simply blown back into the furnace and very little, if any, of it melts. The carbon burns out and the ash leaves the furnace a second, third, fourth or more times as flyash.

Such techniques are sometimes applied to dry bottom pulverized coal burning furnaces but are most often applied to stoker furnaces, all of which are dry bottom.

SUMMARY OF THE INVENTION

We provide a system for recycling flyash in which a very large portion of the recycled flyash is fused and sticks together or agglomerates so that it passes out of the furnace as bottom ash. Collected flyash is returned to the furnace by a carrier gas, usually air. As the flyash and carrier stream is injected into the furnace, a sufficient amount of auxiliary fuel, preferably natural gas, is mixed with the carrier to burn and fuse the flyash. Usually the carrier air will be sufficient to burn the auxiliary fuel, and if it is not, the oxygen in the combustion products from the primary burners can be used to help burn the auxiliary fuel. At times it may be desirable to add air with the fuel. An ignitor may be required. Occasionally it will be desirable to add a fluxing agent to reduce the fusion temperature of the ash. This stream of fused or softened and sticky flyash and carrier gas can be directed towards a furnace wall, or if the flyash particles are soft enough to stick together on impact, the stream can directed so the agglomerates fall into the bottom hopper which is usually filled with water. In this manner the flyash will be converted to bottom ash.

DESCRIPTION OF THE PREFERRED EMBODIMENTS

Figure 1:
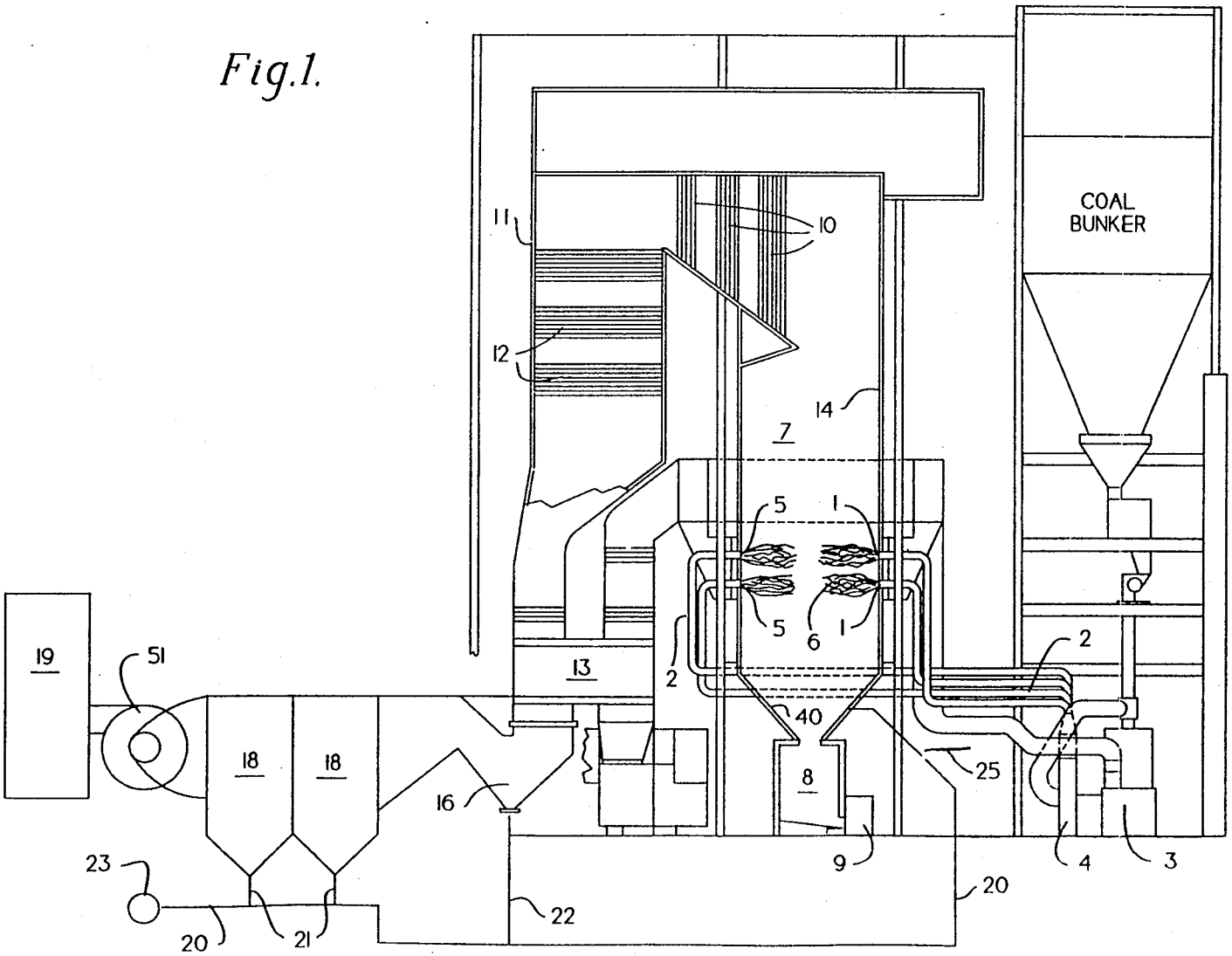
FIG. 1 is a diagram of a prior art dry bottom pulverized coal burning furnace and boiler apparatus modified to fit our method.

Referring to FIG. 1, a furnace having at least one burner is shown. The furnace could be a stoker or a pulverized coal fired furnace. A stream of pulverized coal is blown into the burner 1 through coal pipes 2 after the coal was pulverized in mill 3 and drawn from the mill by exhauster 4. The coal may be bituminous, anthracite, subbituminous, lignite or any combination thereof. Secondary air is introduced through an annular opening 5 around the primary air-coal pipe to burn the coal. Primary flames 6 are produced. The combustion products along with most of the ash fill the furnace 7 while some of the ash sticks to the walls and falls off or is removed by soot blowers (not shown) to fall in the ash pit 8. The ash pit is largely filled with water. From the ash pit the ash is crushed and pumped by pump 9 along with carrier water to a recovery or disposal area (not shown). Combustion gases and flyash travel through the superheater and reheater sections 10 if they are part of the boiler. They then travel through boiler 11 and economizer sections 12 if the furnace is so fitted. From the economizer the gases travel through the air heater 13. The hot combustion products give up much of their heat first to the water walls 14 where water is heated and converted to steam, then to superheater and reheater sections where steam is heated, then to a boiler where steam is made from water, then to an economizer where water is heated, and finally to the air heater where air is heated. The preferred embodiment may not always include all of these elements. For instance, not all boilers have reheaters, nor superheaters, nor convective pass boilers 11, nor air heaters, and some do not have economizers. In addition, the order may be different than the one shown here. This is the most common arrangement. From the air heater the gases flow through a sharp bend 16 where some of the flyash may be collected. From this point the flyash and gas pass into a dust collector 18 and from the dust collector into the stack 19 via an induced draft fan 51.

Our recycling process utilizes pressurized carrier gas in line 20 supplied by a fan or compressor 23 to educt the captured flyash from the dust collectors 18 through conduits 21 and from the gravity collector 16 through conduit 22. The collected flyash is then conveyed to the furnace 7 and directed at the lower hopper 40, which while it is sloped is formed from water wall tubes. The carrier gas may be air, flue gas, steam or other gas, but is preferably air. Auxiliary fuel such as coal, natural gas or liquified petroleum gas is injected thru line 25 into the carrier gas 20 causing combustion and softening or fusion of the flyash. The ash impinges on the opposite hopper at which time it is desirable that it not be molten. We have found that most of the recycled flyash is recovered as bottom ash. The ash may be recycled from a baghouse, an electrostatic precipitator, a gravity separator such as a low spot in the ductwork, a sharply curved duct or from a mechanical collector such as a cyclone collector or multiclone collector.

Figure 2:
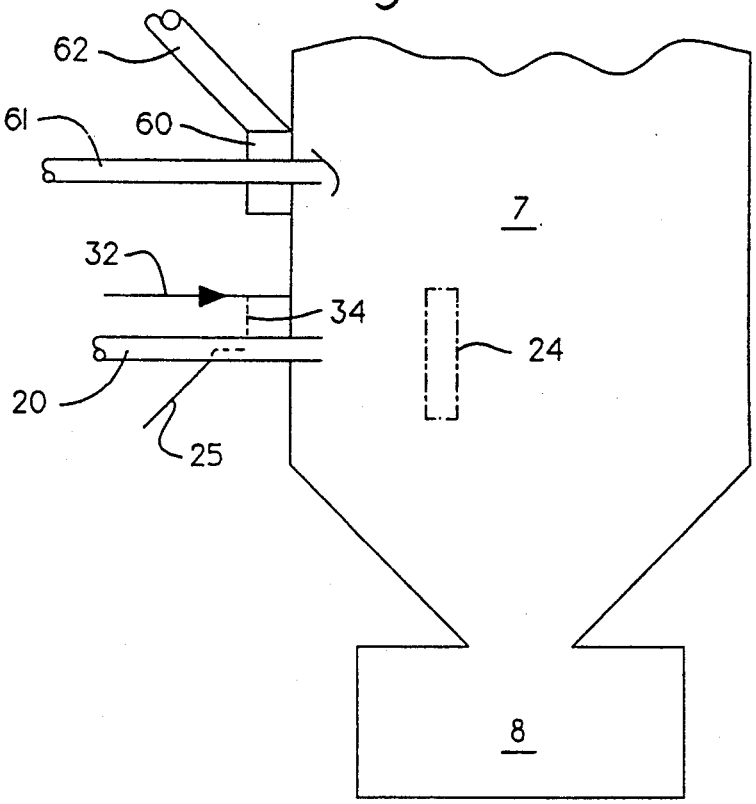
FIG. 2 is a more detailed diagram showing flyash being injected into the bottom of the furnace.

As illustrated in FIG. 2, the collected ash is injected into the furnace in a stream of carrier gas through a primary line 20. This stream is mixed with fuel through line 25, which is preferably natural gas, and with additional air, if necessary, which enters through a secondary inlet 32. Line 25 may extend into line 20 to introduce the fuel into the center of the flyash and carrier gas stream. Air inlet 32 could also be configured to introduce air into that stream as indicated by dotted line 34. The amount of additional air required may be 0.5 to 5 pounds per pound of flyash. Combustion occurs which softens the ash and makes it sticky. Inlets 20 and 32 are positioned to direct the stream against the opposite wall or against the opposite slope of the furnace. Also shown in FIG. 2 is a primary burner 61 with a coal pipe 62 through which coal and primary air flow and an inlet 62 for secondary air.

It is necessary to soften the flyash so it will stick together, but the flyash cannot be melted. If the flyash melts completely it will probably stick tenaciously to the furnace walls and it may not be possible to remove the flyash without taking the furnace out of service. The lost production is very expensive and the removal of previously molten ash or slag is difficult and can require dynamite. Thus, it is necessary to soften or make the ash particles sticky without melting them. Flyash is a mixture of compounds and like most mixtures transforms from a solid to a liquid over a large temperature range. In contrast most pure compounds melt at a single temperature, so it would be almost impossible to soften them without melting them. Table 1 shows the various temperatures for different points on the solid-liquid transformation progression. The samples are shaped into cones and in this case heated under an atmosphere containing no oxygen but containing some fuel. The results are called Ash Fusion Temperatures (Reducing Conditions). The first, second and fourth headings should be obvious and the third one is the temperature at which the cone has assumed the shape of the top half of a ball.

TABLE 1

| Ash Fusion Temperatures for Three Coals | | | | |
|---|---|---|---|---|
| Coal | Initial Deformation | Softening H = W | Hemispherical H = ½ W | Fluid, °F. |
| 1 | 2250 | 2310 | 2490 | 2530 |
| 2 | 2240 | 2300 | 2430 | 2530 |
| 3 | >2800 | >2800 | >2800 | >2800 |

This table shows that the fusion of the ash from the first two coals takes place over about 300° F. and it is possible to bring ash to softness without melting it. The third sample does not show the actual points but it does show that there are great differences between coals. As one might expect, individual coals will give different results at different times. Consequently, it may be necessary to adjust the amount of auxiliary fuel used to soften the ash.

In the case of the third coal or for many others it may be desirable to use a fluxing agent to reduce the fusion temperature of the ash or simply to provide a fluid phase which will serve to stick the solid ash particles together. Suitable fluxing agents include limestone in the case of high iron low calcium ashes. Iron, rust, slag, or other iron-containing materials are suitable fluxing agents for high calcium ash.

Figure 3:
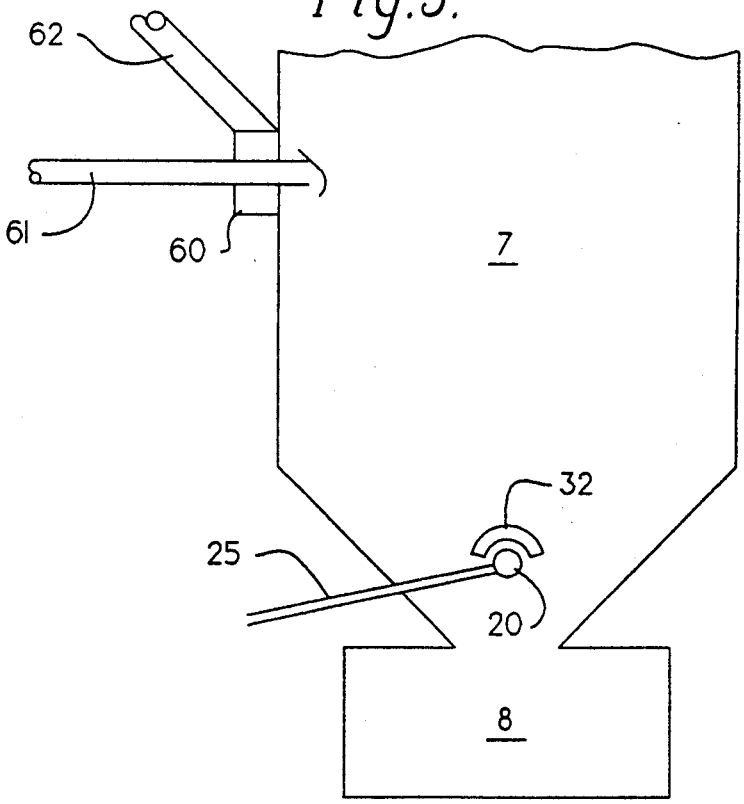
FIG. 3 is a more detailed diagram showing flyash being injected so it falls directly into the bottom hopper without striking any furnace wall, according to our second preferred embodiment of the invention.

Our method can also be practiced by injecting the ash so it falls directly out of the bottom of the furnace into the water in the ash pit 8 as shown in FIG. 3. In this case it is possible to heat the ash until it is completely melted since it will have no chance of sticking to the walls.

Figure 4:
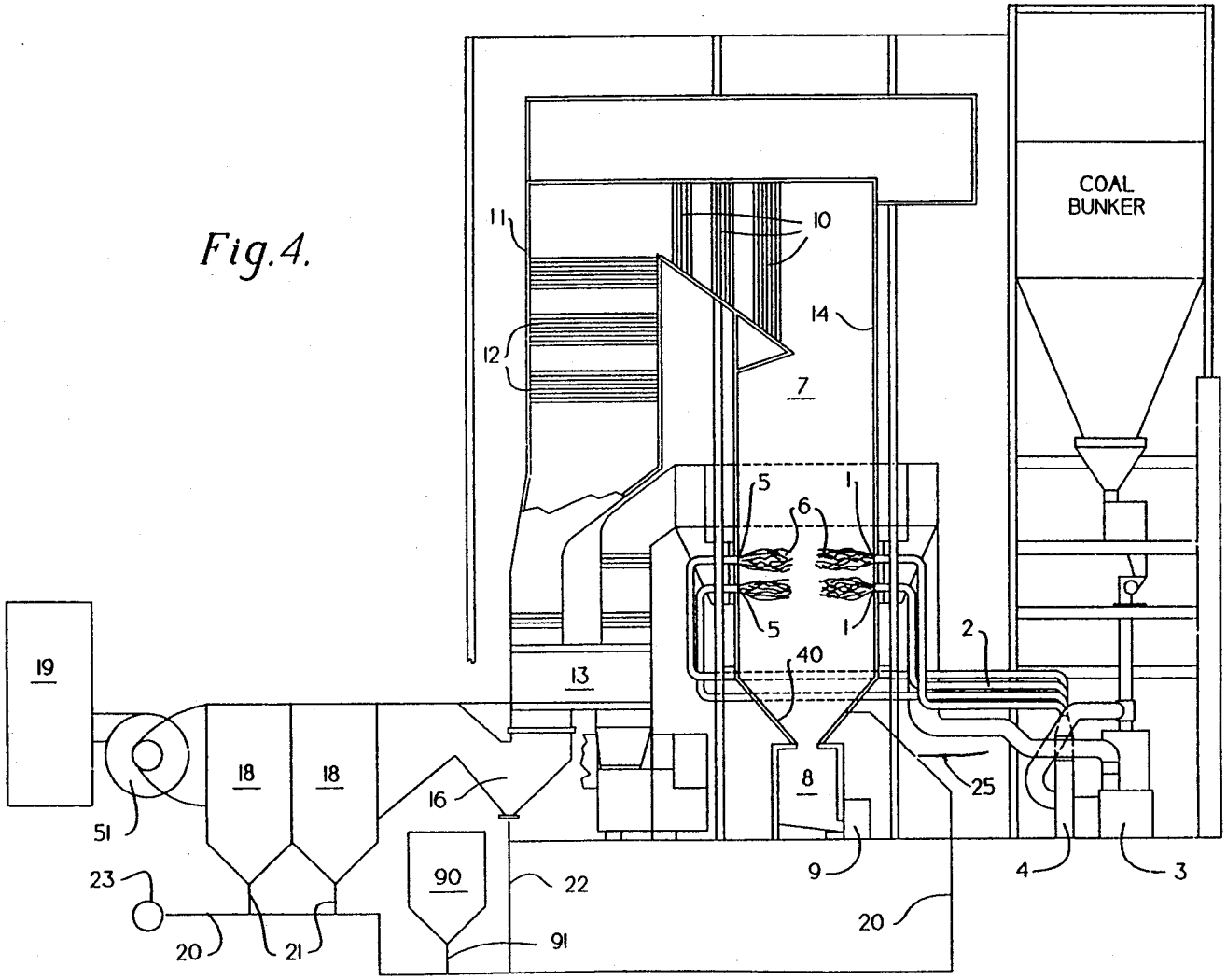
FIG. 4 is a diagram similar to FIG. 1 showing a second preferred embodiment of our process wherein a fluxing agent is added to the flyash.

Our method wherein a fluxing agent is used can be practiced as shown in FIG. 4. In this embodiment the fluxing agent is placed in bunker 90 and added to the flyash air mixture through line 91. Suitable fluxing agents include limestone in the case of high iron low calcium ash. Iron, rust, slag, or other iron-containing materials are suitable fluxing agents for high calcium ash. At this point one could also add a material such as sodium sulfate which causes the flyash to melt and stick together.

One pound of ash may require one pound of air as carrier gas. The air and ash may require 1800 Btu or 1.8 cubic feet of natural gas to raise the ash to softening temperature. This amount of natural gas is about 40% more than can be burned by one pound of air. The difference can be made up by using 1.4 pounds of carrier air per pound of ash, adding secondary air, or by relying on residual oxygen in the furnace to complete the combustion of the natural gas or other fuel.

EXAMPLE 1

A 200 MW electrical generating unit with a heat rate of 9250 Btu/kWh firing 12,500 Btu/lb coal will use 148,000 lb/hour (74 tons/hour) of coal. If the coal is 11% ash and 80% of the ash shows up as flyash the unit will produce 13,024 lb/hour of flyash. At 6800 hours/-year operation at full load, the unit would produce 88,563,200 lbs or over 44,000 tons of flyash annually. At a rate of 2 cubic feet of natural gas per pound of flyash, this requires about 175,000,000 cubic feet per year of natural gas. At $2.5 per thousand cubic feet of natural gas the cost would be around $440,000 per year. If the coal costs $1.5 per million Btu and 75% of the above gas goes to replace coal, the reduction in coal cost would be (175,000)×(0.75)×(1.5)=$196,875. On the other hand, the cost of disposal of 44,000 tons of hazardous waste annually could be conservatively $2,000,000, while the disposal of 44,000 tons of non-hazardous waste would be no more than $500,000. Thus a net savings of $1,256,875 can be made.

EXAMPLE 2

A 400 MW electrical generating unit with a heat rate of 10,000 Btu/kWh firing 12,000 Btu/lb coal will use 333,333 lb/hour (167 ton/hour) of coal. If the coal is 12% ash and 75% of the ash shows up as flyash, the unit will produce 30,000 lb/hour flyash. At 6000 hours/year at full load, the unit will produce 180,000,000 lbs or 90,000 tons of flyash annually. At a rate of 2 cubic feet of natural gas per pound of flyash, this requires 360,000,000 cubic feet per year of natural gas. At $2.00 per thousand cubic feet of natural gas, this is $720,000 per year for natural gas. If the coal costs $1.25 per million Btu and 80% of the gas goes to replace coal, the coal savings would be (360,000)×(0.80)×(1.25)=$360,000. The cost of disposal of 90,000 tons of flyash even if it is non-toxic is estimated to be $900,000 and the bottom ash could potentially be sold for a net of $180,000/year. The savings are $720,000 per year.

The invention is not limited to the described preferred embodiments but may be practiced within the scope of the following claims.

We claim:

1. A process for the reduction of flyash production from a dry bottom boiler of the type firing pulverized coal, the process comprising the steps of:

(a) collecting the flyash from a collector selected from the group comprising an of an electrostatic precipitator, a baghouse, a cyclone collector, a multiclone collector, a gravity separator and a sharply curved duct;

(b) removing the flyash in a stream of carrier gas;

(c) adding a fuel to the stream of carrier gas and flyash; and (d) introducing the carrier gas, flyash and fuel into the boiler in a manner so that heat from burning the fuel and the heat from at least one of surrounding gas and slag provide energy to heat and soften the flyash so that the softened flyash is agglomerated and falls into a bottom ash pit.

2. A process as described in claim 1 wherein the carrier gas is at least one gas selected from the group consisting of air, flue gas, natural gas and steam.

3. A process as described in claim 1 wherein the fuel is a fuel selected from the group consisting of coal, natural gas and liquified petroleum gas.

4. A process as described in claim 1 wherein the fuel is introduced centrally within the flyash and carrier gas.

5. A process as described in claim 1 further comprising the step of adding additional air to the flyash.

6. A process as described in claim 5 wherein the additional air is added as a carrier gas for the flyash.

7. A process as described in claim 1 wherein a portion of an oxidant for the fuel is oxygen from surrounding products of combustion.

8. A process as described in claim 7 wherein all of the oxidant for reaction with the fuel comes from the surrounding products of combustion.

9. A process as described in claim 1 wherein the furnace is one of a stoker and a pulverized coal fired boiler.

10. A process as described in claim 1 wherein the coal is comprised of at least one type of coal selected from the group consisting of bituminous, anthracite, subbituminous, and lignite.

11. A process as described in claim 1 wherein the flyash is directed toward a wall of the furnace.

12. A process as described in claim 1 wherein the flyash is directed toward the bottom slope of the furnace.

13. A process as described in claim 1 wherein the flyash is directed so it falls directly into the ash pit.

14. A process as described in claim 1 wherein a fluxing agent is added to the collected flyash.

15. A process as described in claim 14 wherein the fluxing agent is a calcium-containing material.

16. A process as described in claim 15 wherein the fluxing agent is one of lime and limestone.

17. A process as described in claim 14 wherein the fluxing agent is an iron-containing material.

18. A process as described in claim 17 wherein the fluxing agent is slag from iron or steel making processes.

19. A process as described in claim 1 wherein a material which melts and sticks the ash together is added to the recycled flyash.

20. A process as described in claim 19 wherein the melting material is sodium sulfate.

21. A process for the reduction of flyash production from a dry bottom boiler, the process comprising the steps of:

(a) collecting the flyash from one of an electrostatic precipitator, a baghouse, a multiclone collector, a gravity separator, and a sharply turning duct;
(b) removing the flyash in a stream of carrier gas;
(c) adding a softening agent which is comprised of at least one of a lower melting material and a fluxing material to the stream of carrier gas and flyash;
(d) introducing the carrier gas, flyash and softening agent into the boiler in a manner so that heat of the boiler will soften the flyash and softening agent;
(e) directing the stream so the flyash, softening agent and any other solid material will agglomerate; and
(f) discharging the agglomerated flyash with the bottom ash from the furnace bottom.

22. A process as described in claim 21 wherein the fluxing material is a calcium-containing material.

23. A process as described in claim 22 wherein the calcium-containing material is one of lime or limestone.

24. A process as described in claim 21 wherein the fluxing material is an iron-containing material.

25. A process as described in claim 24 wherein the iron-containing material is slag from iron or steel making.

26. A process as described in claim 21 wherein the softening agent is sodium sulfate.

* * * * *